US011388932B2

(12) United States Patent
Courbat et al.

(10) Patent No.: US 11,388,932 B2
(45) Date of Patent: Jul. 19, 2022

(54) AEROSOL-GENERATING DEVICE WITH FLAT INDUCTOR COIL

(71) Applicant: Philip Morris Products S.A., Neuchâtel (CH)

(72) Inventors: Jerome Christian Courbat, Cortaillod (CH); Michel Bessant, Neuchatel (CH); Tony Reevell, London (GB); Andreas Michael Rossoll, Le Mont-sur-Lausanne (CH); Enrico Stura, Palézieux-Village (CH)

(73) Assignee: Philip Morris Products S.A., Neuchatel (CH)

( * ) Notice: Subject to any disclaimer, the term of this patent is extended or adjusted under 35 U.S.C. 154(b) by 99 days.

(21) Appl. No.: 16/636,657

(22) PCT Filed: Aug. 9, 2018

(86) PCT No.: PCT/EP2018/071707
§ 371 (c)(1),
(2) Date: Feb. 5, 2020

(87) PCT Pub. No.: WO2019/030363
PCT Pub. Date: Feb. 14, 2019

(65) Prior Publication Data

US 2021/0145062 A1 May 20, 2021

(30) Foreign Application Priority Data

Aug. 9, 2017 (EP) ..... 17185599

(51) Int. Cl.
*A24F 13/00* (2006.01)
*A24F 40/465* (2020.01)
(Continued)

(52) U.S. Cl.
CPC ..... *A24F 40/465* (2020.01); *A24F 40/485* (2020.01); *A24F 40/57* (2020.01);
(Continued)

(58) Field of Classification Search
CPC ..... A24F 40/465; A24F 47/00
(Continued)

(56) References Cited

U.S. PATENT DOCUMENTS

2012/0067870 A1 3/2012 Lasko
2015/0245669 A1 9/2015 Cadieux et al.
(Continued)

FOREIGN PATENT DOCUMENTS

CN 106418703 A 2/2017
CN 206227716 U 6/2017
(Continued)

OTHER PUBLICATIONS

Extended European Search Report dated Feb. 28, 2018, in Patent Application No. 17185599.2, 18 pages.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including a housing defining a chamber having an open end configured for insertion of an aerosol-generating article into the chamber and a closed end disposed opposite the open end; a flat spiral inductor coil disposed at the closed end of the chamber; a susceptor element disposed within the chamber at the closed end; and a power supply and a controller connected to the flat spiral inductor coil and configured to provide an alternating electric current to the flat spiral inductor coil such that the flat spiral inductor coil is configured to generate an alternating magnetic field to inductively heat the susceptor
(Continued)

element and thereby to heat at least a portion of an aerosol-generating article received within the chamber.

15 Claims, 5 Drawing Sheets

(51) Int. Cl.
*A24F 40/485* (2020.01)
*A24F 40/57* (2020.01)
*H05B 6/10* (2006.01)
*H05B 6/44* (2006.01)
*A24F 40/20* (2020.01)

(52) U.S. Cl.
CPC ..... *H05B 6/105* (2013.01); *H05B 6/44* (2013.01); *A24F 40/20* (2020.01)

(58) Field of Classification Search
USPC ..... 131/329
See application file for complete search history.

(56) References Cited

U.S. PATENT DOCUMENTS

| | | | | |
|---|---|---|---|---|
| 2017/0055580 | A1 | 3/2017 | Blandino et al. | |
| 2017/0079330 | A1 | 3/2017 | Mironov et al. | |
| 2017/0119050 | A1 | 5/2017 | Blandino et al. | |
| 2017/0119054 | A1* | 5/2017 | Zinovik | A24F 40/465 |
| 2017/0231278 | A1* | 8/2017 | Mironov | G01F 23/24 392/390 |
| 2018/0070639 | A1* | 3/2018 | Chen | H05B 6/105 |
| 2018/0125119 | A1 | 5/2018 | Cadieux et al. | |
| 2018/0289067 | A1* | 10/2018 | Courbat | H05B 6/108 |
| 2018/0352862 | A1* | 12/2018 | Mironov | A24F 40/465 |

FOREIGN PATENT DOCUMENTS

| | | | |
|---|---|---|---|
| RU | 2 600 912 | C1 | 10/2016 |
| WO | WO 95/27411 | A1 | 10/1995 |
| WO | WO 2014/048745 | A1 | 4/2014 |
| WO | WO 2015/131058 | A1 | 9/2015 |
| WO | WO 2015/175568 | A1 | 11/2015 |
| WO | WO 2015/176898 | A1 | 11/2015 |
| WO | WO 2015/177043 | A1 | 11/2015 |
| WO | WO 2015/177044 | A1 | 11/2015 |
| WO | WO 2015/177045 | A1 | 11/2015 |
| WO | WO 2015/177046 | A1 | 11/2015 |
| WO | WO 2015/177247 | A1 | 11/2015 |
| WO | WO 2015/177252 | A1 | 11/2015 |
| WO | WO 2015/177253 | A1 | 11/2015 |
| WO | WO 2015/177254 | A1 | 11/2015 |
| WO | WO 2015/177257 | A1 | 11/2015 |
| WO | WO 2015/177263 | A1 | 11/2015 |
| WO | WO 2015/177264 | A1 | 11/2015 |
| WO | WO 2015/177265 | A1 | 11/2015 |
| WO | WO 2015/198015 | A1 | 12/2015 |
| WO | WO 2016/075436 | A1 | 5/2016 |
| WO | WO 2016/090037 | A1 | 6/2016 |
| WO | WO 2016/156500 | A1 | 10/2016 |
| WO | WO 2016/184928 | A1 | 11/2016 |
| WO | WO 2016/184929 | A1 | 11/2016 |
| WO | WO 2016/184930 | A1 | 11/2016 |
| WO | WO 2017/001818 | A1 | 1/2017 |
| WO | WO 2017/001819 | A1 | 1/2017 |
| WO | WO 2017/001820 | A1 | 1/2017 |
| WO | WO 2017/005705 | A1 | 1/2017 |
| WO | WO 2017/029268 | A1 | 2/2017 |
| WO | WO 2017/029269 | A1 | 2/2017 |
| WO | WO 2017/029270 | A1 | 2/2017 |
| WO | WO 2017/036950 | A2 | 3/2017 |
| WO | WO 2017/036951 | A1 | 3/2017 |
| WO | WO 2017/036954 | A1 | 3/2017 |
| WO | WO 2017/036955 | A2 | 3/2017 |
| WO | WO 2017/036957 | A1 | 3/2017 |
| WO | WO 2017/036958 | A2 | 3/2017 |
| WO | WO 2017/036959 | A1 | 3/2017 |
| WO | WO 2017/064487 | A1 | 4/2017 |
| WO | WO 2017/068092 | A1 | 4/2017 |
| WO | WO 2017/068095 | A1 | 4/2017 |
| WO | WO 2017/068098 | A1 | 4/2017 |
| WO | WO 2017/068099 | A1 | 4/2017 |
| WO | WO 2017/068100 | A1 | 4/2017 |
| WO | WO 2017/072144 | A1 | 5/2017 |
| WO | WO 2017/072145 | A1 | 5/2017 |
| WO | WO 2017/072146 | A1 | 5/2017 |
| WO | WO 2017/072148 | A1 | 5/2017 |
| WO | WO 2017/072149 | A1 | 5/2017 |
| WO | WO 2017/077503 | A1 | 5/2017 |
| WO | WO 2017/085242 | A1 | 5/2017 |
| WO | WO 2019/030000 | A1 | 2/2019 |
| WO | WO 2019/030301 | A1 | 2/2019 |
| WO | WO 2019/030353 | A1 | 2/2019 |
| WO | WO 2019/030360 | A1 | 2/2019 |
| WO | WO 2019/030361 | A1 | 2/2019 |
| WO | WO 2019/030363 | A1 | 2/2019 |
| WO | WO 2019/030364 | A1 | 2/2019 |
| WO | WO 2019/030366 | A1 | 2/2019 |

OTHER PUBLICATIONS

International Search Report and Written Opinion dated Nov. 26, 2018 in PCT/EP2018/071707 filed on Aug. 9, 2018.

Combined Notice of Allowance and Search Report dated Nov. 24, 2021 in Russian Patent Application No. 2020109519 (with English translation). citing document AO therein, 18 pages.

* cited by examiner

AEROSOL-GENERATING DEVICE WITH FLAT INDUCTOR COIL

CROSS-REFERENCE TO RELATED APPLICATIONS

This application is a U.S. national stage application of PCT/EP2018/071707, filed on Aug. 9, 2018, which is based upon and claims the benefit of priority from European patent application no. 17185599.2, filed Aug. 9, 2017, the entire contents of each of which are incorporated herein by reference.

TECHNICAL FIELD

The present invention relates to an aerosol-generating device having a flat spiral inductor coil and a susceptor element. The present invention also relates to an aerosol-generating system comprising the aerosol-generating device and an aerosol-generating article.

DESCRIPTION OF THE RELATED ART

A number of electrically-operated aerosol-generating systems in which an aerosol-generating device having an electric heater is used to heat an aerosol-forming substrate, such as a tobacco plug, have been proposed in the art. One aim of such aerosol-generating systems is to reduce known harmful smoke constituents of the type produced by the combustion and pyrolytic degradation of tobacco in conventional cigarettes. Typically, the aerosol-generating substrate is provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element such as a heating blade is inserted into or around the aerosol-forming substrate when the article is received in the aerosol-generating device. In other aerosol-generating systems, an inductive heater is used rather than a resistive heating element. The inductive heater typically comprises an inductor forming part of the aerosol-generating device and an electrically conductive susceptor element fixed within the aerosol-generating device and arranged such that it is in thermal proximity to the aerosol-forming substrate. During use, the inductor generates an alternating magnetic field to generate eddy currents and hysteresis losses in the susceptor element, causing the susceptor element to heat up, thereby heating the aerosol-forming substrate.

Inductive heating systems require two components, that is, an inductor and a susceptor element. This may add complexity to the manufacture and assembly of the aerosol-generating device and may increase the size of the aerosol-generating device when compared to devices comprising a resistive heater.

It would be desirable to provide an aerosol-generating device comprising an inductive heating system that mitigates or overcomes these problems with known systems.

SUMMARY

According to a first aspect of the present invention there is provided an aerosol-generating device comprising a housing defining a chamber having an open end for insertion of an aerosol-generating article into the chamber and a closed end opposite the open end. The aerosol-generating device also comprises a flat spiral inductor coil disposed at the closed end of the chamber and a susceptor element positioned within the chamber at the closed end. The aerosol-generating device also comprises a power supply and a controller connected to the flat spiral inductor coil and configured to provide an alternating electric current to the flat spiral inductor coil such that, in use, the flat spiral inductor coil generates an alternating magnetic field to inductively heat the susceptor element and thereby heat at least a portion of an aerosol-generating article received within the chamber.

According to a second aspect of the present invention there is provided an aerosol-generating system. The aerosol-generating system comprises an aerosol-generating device according to the first aspect of the present invention, in accordance with any of the embodiments described herein. The aerosol-generating system also comprises an aerosol-generating article having an aerosol-forming substrate and configured for use with the aerosol-generating device.

BRIEF DESCRIPTION OF THE DRAWINGS

The invention is further described, by way of example only, with reference to the accompanying drawings in which.

DETAILED DESCRIPTION

Figure 1:
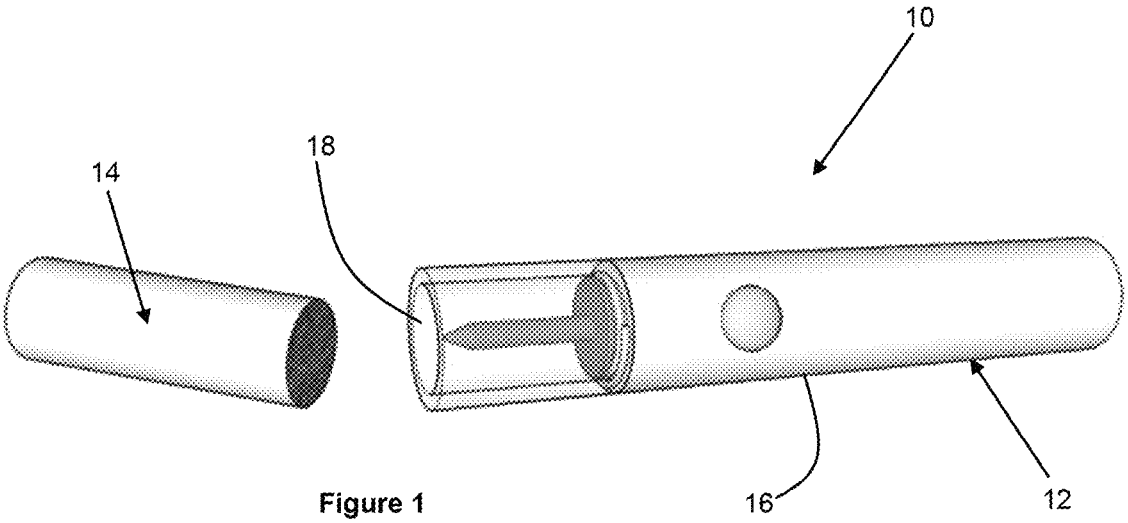
FIG. 1 shows a perspective view of an aerosol-generating system according to an embodiment of the present invention.

As used herein a "flat spiral inductor coil" means a coil that is generally planar coil wherein the axis of winding of the coil is normal to the surface in which the coil lies. Preferably, the flat spiral coil is planar in the sense that it lies in a flat Euclidean plane.

As used herein, the term "longitudinal" is used to describe the direction along the main axis of the aerosol-generating device, or of an aerosol-generating article, and the term 'transverse' is used to describe the direction perpendicular to the longitudinal direction. When referring to the chamber, the term 'longitudinal' refers to the direction in which an aerosol-generating article is inserted into the chamber and the term 'transverse' refers to a direction perpendicular to the direction in which an aerosol-generating article is inserted into the chamber.

As used herein, the term "width" refers to the major dimension in a transverse direction of a component of the aerosol-generating device, or of an aerosol-generating article, at a particular location along its length. The term "thickness" refers to the dimension of a component of the aerosol-generating device, or of an aerosol-generating article, in a transverse direction perpendicular to the width.

As used herein, the term "aerosol-forming substrate" relates to a substrate capable of releasing volatile compounds that can form an aerosol. Such volatile compounds may be released by heating the aerosol-forming substrate. An aerosol-forming substrate is part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In an aerosol-generating system, the aerosol-generating article and the aerosol-generating device cooperate to generate a respirable aerosol.

As used herein, the term "elongate" refers to a component having a length which is greater than both its width and thickness, for example twice as great.

As used herein, a "susceptor element" means an electrically conductive element that heats up when subjected to a changing magnetic field. This may be the result of eddy currents induced in the susceptor element, hysteresis losses, or both eddy currents and hysteresis losses. The susceptor element is located in thermal contact or close thermal proximity with the aerosol-forming substrate of an aerosol-generating article received in the chamber of the aerosol-generating device. In this manner, the aerosol-forming substrate is heated by the susceptor element during use such that an aerosol is formed.

Advantageously, providing an inductor coil and a susceptor element as parts of the aerosol-generating device makes it possible to construct an aerosol-generating article that is simple, inexpensive and robust. Aerosol-generating articles are typically disposable and produced in much larger numbers that the aerosol-generating devices with which they operate. Accordingly, reducing the cost of the articles, even if it requires a more expensive device, can lead to significant cost savings for both manufacturers and consumers.

Advantageously, the use of inductive heating rather than resistive heating may provide improved energy conversion because of power losses associated with a resistive heater, in particular losses due to contact resistance at connections between the resistive heater and the power supply.

Advantageously, the use of a flat spiral inductor coil allows for the design of a compact aerosol-generating device, with a simple design that is robust and inexpensive to manufacture. The use of a flat spiral coil also allows for a simple interface between the device and a cartridge, allowing for a simple and inexpensive cartridge design.

As used herein, the terms "upstream" and "downstream" refer to the general direction of airflow. That is, generally, air flows from an upstream end to a downstream end. The airflow may be through the aerosol-generating device or a portion of the aerosol-generating device. The airflow may be through an aerosol-generating article or a portion of an aerosol-generating article. The closed end of the chamber may be an upstream end. The open end of the chamber may be a downstream end.

Preferably, the housing defines a longitudinal axis extending between the closed end and the open end of the chamber, and wherein the flat spiral inductor coil lies within a plane that is orthogonal to the longitudinal axis. Advantageously, this may further simplify the manufacture and assembly of one or both of the inductor coil and the aerosol-generating device.

The housing may define a chamber end wall forming the closed end of the chamber, wherein the flat spiral inductor coil is disposed on the chamber end wall. Advantageously, the chamber end wall supports the flat spiral inductor coil in a desired position and orientation with respect to the chamber. Advantageously, positioning the flat spiral inductor coil on the chamber end wall may facilitate positioning of the inductor coil close to the susceptor element.

Preferably, the chamber end wall comprises a first surface defining the closed end of the chamber and an opposed second surface.

The flat spiral inductor coil may be disposed on the first surface of the end wall within the chamber. Advantageously, this arrangement may minimise or eliminate spacing between the flat spiral inductor coil and the susceptor element. Advantageously, this may maximise heating of the susceptor element during use.

The flat spiral inductor coil may be disposed on the second surface of the end wall. Advantageously, this arrangement positions the flat spiral inductor coil outside of the chamber. That is, the chamber end wall is positioned between the flat spiral inductor coil and the chamber. Advantageously, this may eliminate exposure of the flat spiral inductor coil to aerosol generated within the chamber. Advantageously, this eliminates one or both of deposits forming on the inductor coil and corrosion of the inductor coil.

Preferably, the housing defines a cavity in which the power supply, the controller and the flat spiral inductor coil are positioned, wherein the second surface of the end wall defines a first end of the cavity. Advantageously, this arrangement facilitates electrical connection of the inductor coil with the power supply and the controller. Advantageously, this arrangement may simplify the manufacture and assembly of the aerosol-generating device. The controller, the power supply and the inductor coil may be electrically connected to each other and inserted into the housing as an electronics package.

Preferably, the susceptor element comprises a planar portion disposed within the chamber at the closed end, wherein the planar portion extends within a plane parallel with the flat spiral inductor coil. Advantageously, this arrangement optimises heating of the susceptor element by the flat spiral inductor coil.

As used, herein, the terms "parallel" and "substantially parallel" mean within plus or minus 10 degrees, preferably within plus or minus 5 degrees.

The planar portion may have any suitable shape. The planar portion may have the same shape as the cross-sectional shape of the chamber. The planar portion may have the same shape as the overall shape of the flat spiral inductor coil. The planar portion may have a substantially circular shape.

The susceptor element may comprise at least one airflow aperture extending through the planar portion between a first side of the planar portion and a second side of the planar portion. The at least one airflow aperture may comprise a plurality of airflow apertures. Preferably, the plurality of airflow apertures are evenly spaced from each other. Preferably, the plurality of airflow apertures are distributed symmetrically across the planar portion.

Advantageously, providing at least one airflow aperture extending through the planar portion may facilitate heating of air flowing through the aerosol-generating device. For example, air entering the airflow device may be heated by the planar portion prior to flowing across or through an aerosol-generating article received within the chamber. Preferably, the aerosol-generating device comprises at least one airflow inlet extending through the housing, wherein the at least one airflow inlet is in fluid communication with the first side of the planar portion. Preferably, the first side of the planar portion is positioned nearer to the closed end of the chamber than the second side of the planar portion. Preferably the first side of the planar portion faces the closed end of the chamber. Preferably, the second side of the planar portion is positioned adjacent to or in contact with an aerosol-generating article when the aerosol-generating article is received within the chamber. Preferably, the second side of the planar portion faces the open end of the chamber.

The planar portion may be disc shaped. Each of the one or more airflow apertures extending through the planar portion may be a hole extending through the disc shaped planar portion.

The planar portion may comprise a central hub and a plurality of fins extending radially outward from the central hub. The central hub and the plurality of fins extend in a plane parallel with the flat spiral inductor coil. Each space between adjacent fins may form one of the one or more airflow apertures extending through the planar portion.

In any of the embodiments described herein in which the susceptor element comprises a planar portion, the susceptor element may comprise at least one elongate portion extending from the planar portion and into the chamber. Advantageously, the at least one elongate portion may facilitate heat transfer from the planar portion to an aerosol-generating article received within the chamber.

Preferably, the at least one elongate portion is configured to pierce an aerosol-generating article when an aerosol-generating article is inserted into the chamber. Advantageously, piercing an aerosol-generating article may position the at least one elongate portion inside an aerosol-forming substrate of the aerosol-generating article. Advantageously, this may facilitate the transfer of heat from the planar portion to the aerosol-forming substrate.

The at least one elongate portion may comprise a plurality of elongate portions extending from the planar portion. Advantageously, this may further facilitate the transfer of heat from the planar portion to an aerosol-generating article. Advantageously, a plurality of elongate portions may facilitate more even heating of an aerosol-generating article.

Preferably, the plurality of elongate portions are substantially parallel to each other. Advantageously, this facilitates insertion of the plurality of elongate portions into an aerosol-generating article when the aerosol-generating article is inserted into the chamber.

Preferably, the at least one elongate portion is orthogonal to the planar portion. Preferably, the at least one elongate portion is parallel with the longitudinal axis defined by the housing, as previously described herein. Advantageously, this facilitates insertion of the at least one elongate portion into an aerosol-generating article when the aerosol-generating article is inserted into the chamber.

The at least one elongate portion extends into the chamber from the planar portion, preferably orthogonally with respect to the planar portion. Therefore, inductive heating of the at least one planar portion by the flat spiral inductor coil may be minimal. The primary mechanism for heating the at least one elongate portion may be conductive heat transfer from the planar portion when the planar portion is heated by the flat spiral inductor coil.

In any of the embodiments described herein in which the susceptor element comprises a planar portion, the susceptor element may comprise a sleeve portion extending from a periphery of the planar portion, wherein the sleeve portion is disposed around at least a portion of the chamber for receiving at least a portion of an aerosol-generating article within the sleeve portion. Advantageously, the sleeve portion may facilitate heat transfer from the planar portion to an aerosol-generating article received within the chamber.

The sleeve portion extends from the planar portion and is disposed around at least a portion of the chamber. Therefore, inductive heating of the sleeve portion by the flat spiral inductor coil may be minimal. The primary mechanism for heating the sleeve portion may be conductive heat transfer from the planar portion when the planar portion is heated by the flat spiral inductor coil.

In any of the embodiments described herein, the flat spiral inductor coil may be a first flat spiral inductor coil and the aerosol-generating device may further comprise a second flat spiral inductor coil. In embodiments in which the susceptor element comprises a planar portion, preferably the first flat spiral inductor coil, the second flat spiral inductor coil and the planar portion of the susceptor element are parallel with each other. Preferably, the planar portion is positioned between the first flat spiral inductor coil and the second flat spiral inductor coil. Advantageously, providing a first and second flat spiral inductor coils may increase the inductive heating of the susceptor element.

The planar portion of the susceptor element may be a first planar portion and the susceptor element may further comprise a second planar portion separate from the first planar portion. Preferably, the second planar portion extends within a plane parallel with the second flat spiral inductor coil, wherein the second flat spiral inductor coil is positioned between the first planar portion and the second planar portion. Advantageously, providing first and second inductor coils and first and second planar portions may increase the heating of an aerosol-generating article received within the chamber. Advantageously, providing multiple inductor coils may increase heating without requiring an increase in the electrical current supplied to a single inductor coil. Advantageously, this may facilitate the use of smaller inductor coils, which may facilitate a more compact arrangement.

The aerosol-generating device may comprise more than two flat spiral inductor coils. The susceptor element may comprise more than two planar portions, each separate from each other. In embodiments in which the aerosol-generating device comprises multiple flat spiral inductor coils and multiple planar portions, preferably the flat spiral inductors and the planar portions are arranged in an alternating pattern. That is, preferably no two flat spiral inductor coils are positioned adjacent to each other and preferably no two planar portions are positioned adjacent to each other. Preferably, the flat spiral inductor coils and the planar portions are arranged in an alternating manner along the longitudinal axis of the housing. Preferably, the flat spiral inductor coils and the planar portions are all substantially parallel to each other. Preferably, each of the flat spiral inductor coils and each of the planar portions is substantially orthogonal to the longitudinal axis of the housing.

In any of the embodiments described herein, the aerosol-generating device may further comprise an additional inductor coil disposed around at least a portion of the chamber, wherein the power supply and the controller are connected to the additional inductor coil and configured to provide an alternating electric current to the additional inductor coil. Preferably, the additional inductor coil is a helically wound inductor coil.

Advantageously, the additional inductor coil may provide additional inductive heating of the susceptor element. The additional inductor coil may be particularly advantageous in embodiments in which the susceptor element comprises one or both of at least one elongate portion and a sleeve portion. Advantageously, the additional inductor coil may provide inductive heating of one or both of the at least one elongate portion and the sleeve portion. As described herein, without an additional inductor coil the primary heating mechanism for the at least one elongate portion and the sleeve portion may be conductive heat transfer from the planar portion. Advantageously, in embodiments comprising an additional inductor coil, the primary heating mechanism for the at least one elongate portion and the sleeve portion may be inductive heating by the additional inductor coil.

In any of the embodiments described herein, the susceptor element may be formed from any material that can be inductively heated to a temperature sufficient to aerosolise an aerosol-forming substrate. Suitable materials for the susceptor element include graphite, molybdenum, silicon carbide, stainless steels, niobium, and aluminium. Preferred susceptor elements comprise a metal or carbon. Preferably, the susceptor element comprises or consists of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than about 5 percent, preferably more than about 20 percent, more preferably more than about 50 percent or more than 90 percent of ferromagnetic or paramagnetic materials. Preferred susceptor elements may be heated to a temperature in excess of about 250 degrees Celsius.

The susceptor element may comprise a non-metallic core with a metal layer disposed on the non-metallic core. For example, the susceptor element may comprise one or more metallic tracks formed on an outer surface of a ceramic core or substrate.

The susceptor element may have a protective external layer, for example a protective ceramic layer or protective glass layer. The protective external layer may encapsulate the susceptor element. The susceptor element may comprise a protective coating formed by a glass, a ceramic, or an inert metal, formed over a core of susceptor material.

The susceptor element may have any suitable cross-section. For example, the susceptor element may have a square, oval, rectangular, triangular, pentagonal, hexagonal, or similar cross-sectional shape. The susceptor element may have a planar or flat cross-sectional shape, particularly in embodiments in which the susceptor element comprises only one or more planar portions.

The susceptor element may be solid, hollow, or porous. Preferably, the susceptor element is solid.

In embodiments in which the susceptor element comprises one or more planar portions, preferably each planar portion has a thickness of from about 10 microns to about 200 microns, more preferably from about 15 microns to about 100 microns, most preferably from about 12 microns to about 25 microns. The thickness of each planar portion is measured in a direction between the closed end and the open end of the chamber. In embodiments in which each planar portion comprises a first side and a second side, the thickness of each planar portion is measured between the first side and the second side. Preferably, each planar portion has a width or a diameter of between about 3 millimetres and about 12 millimetres, more preferably between about 4 millimetres and about 10 millimetres, more preferably between about 5 millimetres and about 8 millimetres. The width or diameter of each planar portion is orthogonal to its thickness.

In embodiments in which the susceptor element comprises one or more elongate portions, preferably each elongate portion is in the form of a pin, rod, blade, or plate. Preferably, each elongate portion has a length of between about 5 millimetres and about 15 millimetres, for example between about 6 millimetres and about 12 millimetres, or between about 8 millimetres and about 10 millimetres. Each elongate portion preferably has a width of between about 1 millimetre and about 8 millimetres, more preferably from about 3 millimetres to about 5 millimetres. Each elongate portion may have a thickness of from about 0.01 millimetres to about 2 millimetres. If each elongate portion has a constant cross-section, for example a circular cross-section, it has a preferable width or diameter of between about 1 millimetre and about 5 millimetres.

In embodiments in which the susceptor element comprises a sleeve portion, preferably the sleeve portion has a length of between about 5 millimetres and about 15 millimetres, for example between about 6 millimetres and about 12 millimetres, or between about 8 millimetres and about 10 millimetres. The sleeve portion may have a thickness of from about 0.01 millimetres to about 2 millimetres.

In embodiments in which the susceptor element comprises a planar portion and at least one of an elongate portion and a sleeve portion, the planar portion, the elongate portion and the sleeve portion may be formed from the same material. The planar portion and at least one of the at least one elongate portion and the sleeve portion may be integrally formed as a unitary part.

At least two of the planar portion, the at least one elongate portion and the sleeve portion may be formed from different materials. At least two of the planar portion, the at least one elongate portion and the sleeve portion may be separately formed and connected to each other. At least two of the planar portion, the at least one elongate portion and the sleeve portion may be connected to each other by at least one of an interference fit, a weld and an adhesive.

Preferably, the aerosol-generating device is portable. The aerosol-generating device may have a size comparable to a conventional cigar or cigarette. The aerosol-generating device may have a total length between approximately 30 millimetres and approximately 150 millimetres. The aerosol-generating device may have an external diameter between approximately 5 millimetres and approximately 30 millimetres.

The aerosol-generating device housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

Alternatively, the mouthpiece may be provided as part of an aerosol-generating article.

As used herein, the term "mouthpiece" refers to a portion of an aerosol-generating device that is placed into a user's mouth in order to directly inhale an aerosol generated by the aerosol-generating device from an aerosol-generating article received in the chamber of the housing.

The aerosol-generating device may include a user interface to activate the device, for example a button to initiate heating of the device or display to indicate a state of the device or of the aerosol-forming substrate.

The aerosol-generating device comprises a power supply. The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be a DC power supply. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The power supply may be configured to operate at high frequency. As used herein, the term "high frequency oscillating current" means an oscillating current having a frequency of between about 500 kilohertz and about 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The aerosol-generating device comprises a controller connected to each inductor coil and the power supply. The controller is configured to control the supply of power to each inductor coil from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the inductor coil. Current may be supplied to the inductor coil continuously following activation of the aerosol-generating device or may be supplied intermittently, such as on a puff by puff basis. The controller may advantageously comprise DC/AC inverter, which may comprise a Class-D or Class-E power amplifier.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the chamber of the aerosol-generating device may be arranged such that the article is partially received within the chamber of the aerosol-generating device. The chamber of the aerosol-generating device and the aerosol-generating article may be arranged such that the article is entirely received within the chamber of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 millimetres. Alternatively, the aerosol-forming segment may have a length of approximately 12 millimetres.

The aerosol-generating segment preferably has an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug is approximately 7 millimetres in length in one embodiment, but may have a length of between approximately 5 millimetres to approximately 10 millimetres.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

Figure 2A:
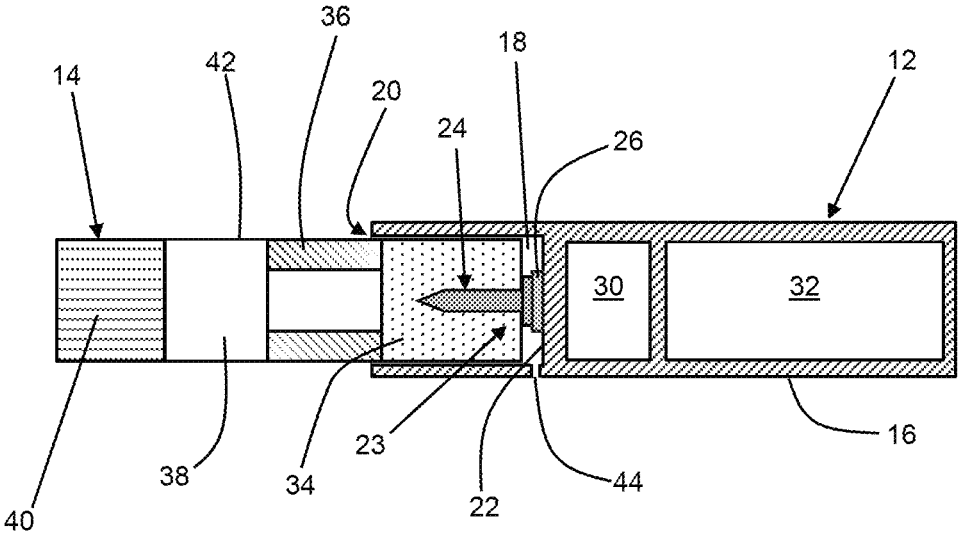
FIG. 2A shows a cross-sectional view of the aerosol-generating system of FIG. 1 with the aerosol-generating article inserted into the aerosol-generating device.

FIGS. 1 and 2 show an aerosol-generating system 10 in accordance with an embodiment of the present invention. The aerosol-generating system 10 comprises an aerosol-generating device 12 and an aerosol-generating article 14.

The aerosol-generating device 12 comprises a housing 16 defining a chamber 18 for receiving a portion of the aerosol-generating article 14. In FIG. 1 a portion of the housing 16 defining the chamber 18 is shown as semi-transparent to illustrate components of the aerosol-generating device 12 disposed within the chamber 18. However, it will be understood that the portion of the housing 16 defining the chamber 18 may comprise an opaque material. The chamber 18 comprises an open end 20 through which the aerosol-generating article 14 is inserted into the chamber 18 and a closed end 22 opposite the open end 20.

Figure 3:
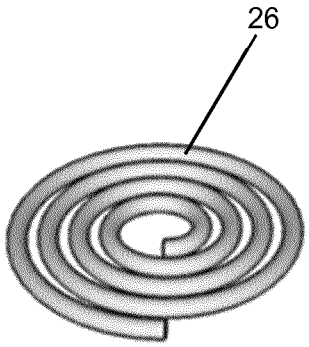
FIG. 3 shows a perspective view of the inductor coil of the aerosol-generating device of FIG. 2A.
Figure 4:
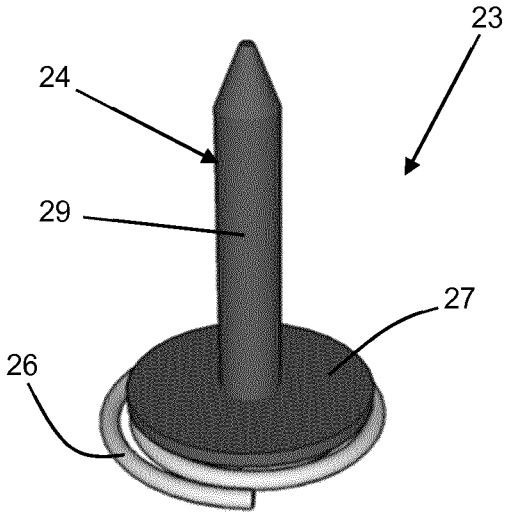
FIG. 4 shows a perspective view of the induction assembly of the aerosol-generating device of FIG. 2A.

The aerosol-generating device 12 also comprises an induction assembly 23 disposed at the closed end 22 of the chamber 18, the induction assembly 23 comprising a susceptor element 24 and an inductor coil 26. As shown more clearly in FIG. 3, the inductor coil 26 is a flat spiral inductor coil. As shown in FIG. 4, the susceptor element 24 comprises a planar portion 27 overlying the flat spiral inductor coil 26 and an elongate portion 29 extending from the planar portion 27.

The aerosol-generating device 12 also comprises a controller 30 and a power supply 32 connected to the flat spiral inductor coil 26. The controller 30 is configured to provide an alternating electric current from the power supply 32 to the flat spiral inductor coil 26 to generate an alternating magnetic field, which inductively heats the planar portion 27 of the susceptor element 24. The primary heating mechanism of the elongate portion 29 of the susceptor element 24 is conductive heat transfer from the planar portion 27.

Figure 2B:
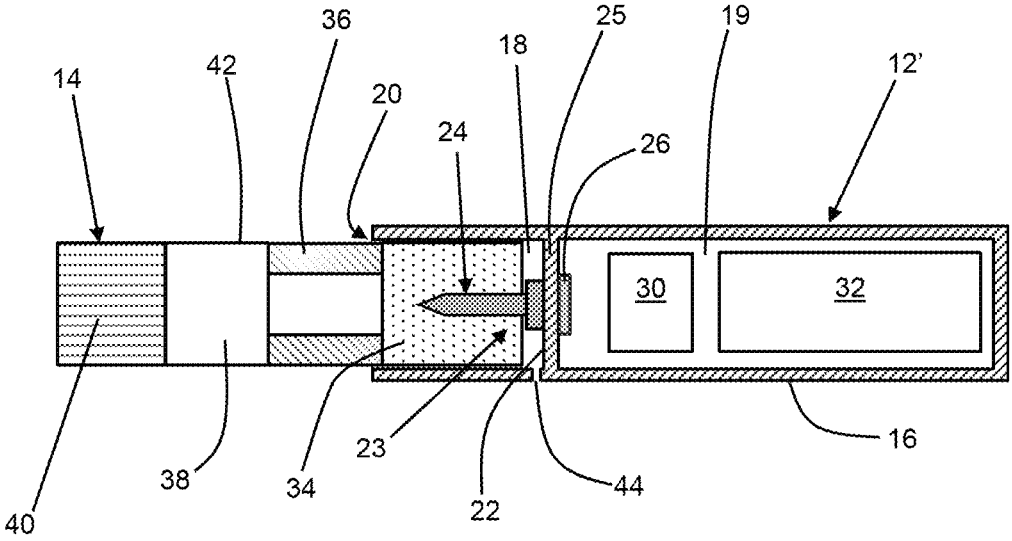
FIG. 2B shows a cross-sectional view of an alternative arrangement of the aerosol-generating device.

FIG. 2B shows an aerosol-generating device 12' having an alternative arrangement of the flat spiral inductor coil 26. In the arrangement shown in FIG. 2B, a chamber end wall 25 defined by the housing 18 comprises a first surface defining the closed end 22 of the chamber 18 and an opposed second surface. The opposed second surface of the chamber end wall 25 defines a first end of a cavity 19 in which the controller 30 and the power supply 32 are disposed. The flat spiral inductor coil 26 is also disposed in the cavity 19 and is disposed on the opposed second surface of the chamber end wall 25.

The aerosol-generating article 14 comprises an aerosol-forming substrate 34 in the form of a tobacco plug, a hollow acetate tube 36, a polymeric filter 38, a mouthpiece 40 and an outer wrapper 42. During use, a portion of the aerosol-generating article 14 is inserted into the chamber 18 and elongate portion 29 of the susceptor element 24 is inserted into the aerosol-forming substrate 34. The controller 30 provides the alternating electric current to the flat spiral inductor coil 26 to inductively heat the susceptor 24, which heats the aerosol-forming substrate 34 to generate an aerosol. The aerosol-generating device 12 comprises an air inlet 44 extending through the housing 16 and providing fluid communication between the exterior of the aerosol-generating device 12 and the chamber 18 adjacent the closed end 22. During use, a user draws on the mouthpiece 40 of the aerosol-generating article 14 to draw an airflow into the chamber 18 via the air inlet 44. The airflow then flows into the aerosol-forming substrate 34 at which point the aerosol is entrained in the airflow. The airflow and aerosol then flow through the hollow acetate tube 36, the polymeric filter 38 and a mouthpiece 40 for delivery to the user.

FIGS. 5 to 13 show several induction assemblies having alternative configurations that may be used with the aerosol-generating device 12 described with reference to FIGS. 1 and 2. The use and operation of the aerosol-generating device comprising any of the induction assemblies shown in FIGS. 5 to 13 is substantially the same as described with reference to the aerosol-generating device 12 of FIGS. 1 and 2. In the following description of the alternative inductions assemblies, like reference numerals are used to designate like parts.

Figure 5:
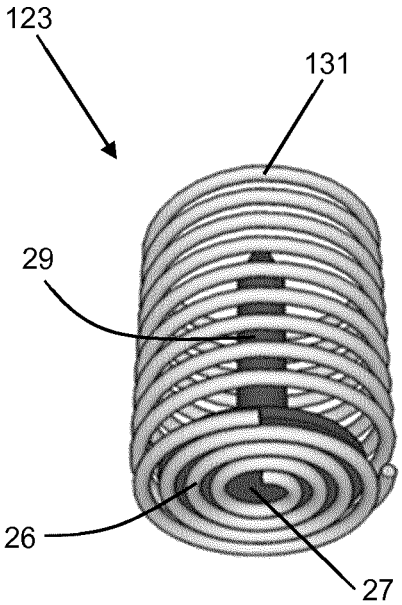
FIG. 5 shows a perspective view of an alternative induction assembly for the aerosol-generating device of FIG. 2A.

FIG. 5 shows an induction assembly 123 that is substantially the same as the induction assembly 23 shown in FIG. 4 and comprises the same susceptor element 24 and flat spiral inductor coil 26. The induction assembly 123 additionally comprises a helical inductor coil 131 extending around the elongate portion 29 of the susceptor element 24. When assembled into the aerosol-generating device 12, the helical inductor coil 131 is disposed around the chamber 18 so that the aerosol-generating article 14 is received within the helical inductor coil 131 when the aerosol-generating article 14 is inserted into the chamber 18. During use, the controller 30 provides an alternating electric current to the flat spiral inductor coil 26 and the helical inductor coil 131 to inductively heat the planar portion 27 and the elongate portion 29 of the susceptor element 24 respectively.

Figure 6:
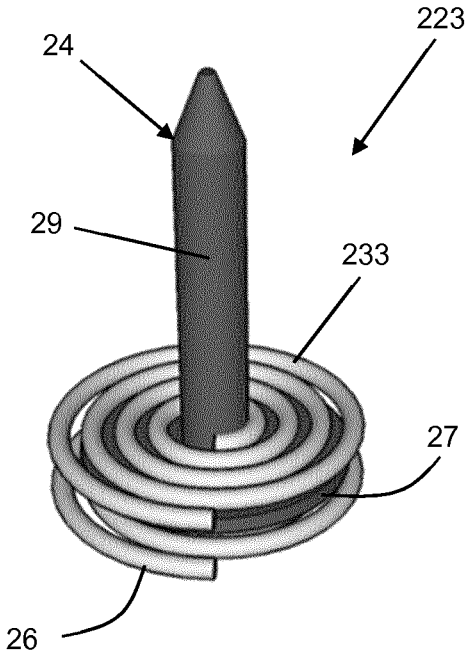
FIG. 6 shows a perspective view of a further alternative induction assembly for the aerosol-generating device of FIG. 2A.

FIG. 6 shows an induction assembly 223 that is substantially the same as the induction assembly 23 shown in FIG. 4 and comprises the same susceptor element 24 and flat spiral inductor coil 26. The flat spiral inductor coil 26 is a first flat spiral inductor coil 26 and the induction assembly 223 additionally comprises a second flat spiral inductor coil 233. The first and second flat spiral inductor coils 26, 233 are arranged so that the planar portion 27 of the susceptor element 24 is positioned between the first and second flat spiral inductor coils 26, 233. During use, the controller 30 provides an alternating electric current to the first and second flat spiral inductor coils 26, 233 to inductively heat the planar portion 27 of the susceptor element 24. Providing two inductor coils increases the inductive heating of the planar portion 27 when compared to the induction assembly 23 shown in FIG. 4.

Figure 7:
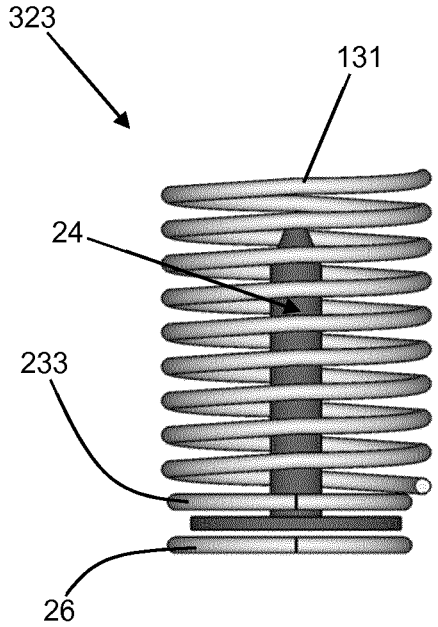
FIG. 7 shows a perspective view of a still further alternative induction assembly for the aerosol-generating device of FIG. 2A.

FIG. 7 shows an induction assembly 323 that is a combination of the induction assemblies 123, 223 shown in FIGS. 5 and 6. That is, the induction assembly 323 comprises first and second flat spiral inductor coils 26, 233 and a helical inductor coil 131.

Figure 8:
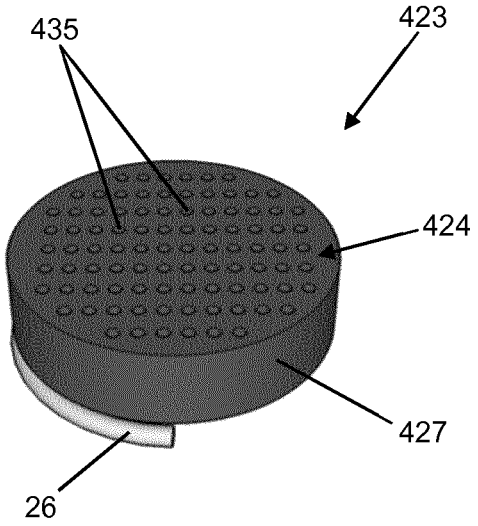
FIG. 8 shows a perspective view of a still further alternative induction assembly for the aerosol-generating device of FIG. 2A.

FIG. 8 shows an induction assembly 423 in which the susceptor element 424 comprises only a planar portion 427. The planar portion 427 comprises a plurality of airflow apertures 435 extending through the planar portion 427. During use, airflow from the air inlet 44 flows through the plurality of airflow apertures 435 to preheat the airflow before it enters the aerosol-forming substrate 34 of the aerosol-generating article 14.

Figure 9:
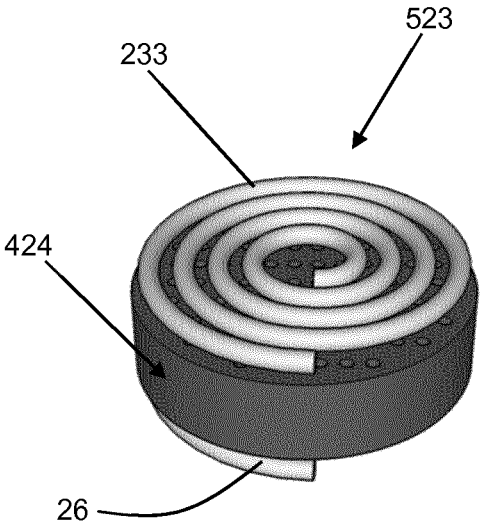
FIG. 9 shows a perspective view of a still further alternative induction assembly for the aerosol-generating device of FIG. 2A.

FIG. 9 shows an induction assembly 523 that is substantially the same as the induction assembly 423 shown in FIG. 8 and comprises the same susceptor element 424 and flat spiral inductor coil 26. The flat spiral inductor coil 26 is a first flat spiral inductor coil 26 and the induction assembly 523 additionally comprises a second flat spiral inductor coil 233. The first and second flat spiral inductor coils 26, 233 are arranged so that the planar portion 427 of the susceptor element 424 is positioned between the first and second flat spiral inductor coils 26, 233. As described with reference to FIG. 6, providing two flat spiral inductor coils increases the inductive heating of the planar portion 427 of the susceptor element 424.

Figure 10:
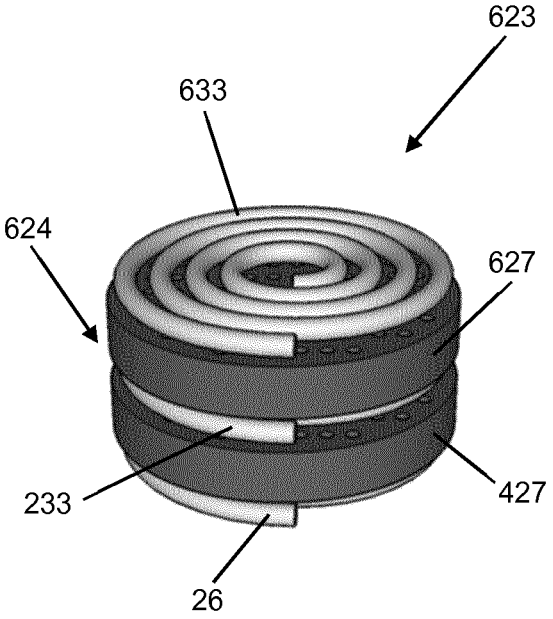
FIG. 10 shows a perspective view of a still further alternative induction assembly for the aerosol-generating device of FIG. 2A.

FIG. 10 shows an induction assembly 623 that is similar to the induction assembly 523 shown in FIG. 9. The planar portion 427 is a first planar portion 427 and the susceptor element 624 further comprises a second planar portion 627 identical to the first planar portion 427. The second flat inductor coil 233 is positioned between the first and second planar portions 427, 627. The induction assembly 623 also comprises a third flat spiral inductor coil 633 overlying the second planar portion 627. The addition of a second planar portion 627 and a third flat spiral inductor coil 633 increase heating of the aerosol-forming substrate 34 during use.

Figure 11:
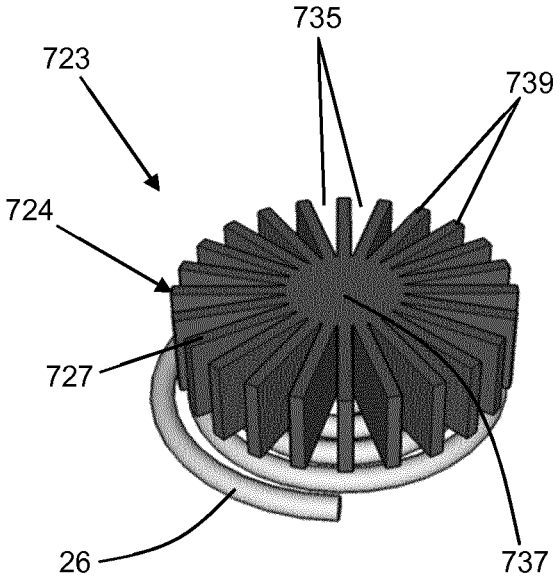
FIG. 11 shows a perspective view of a still further alternative induction assembly for the aerosol-generating device of FIG. 2A.

FIG. 11 shows an induction assembly 723 that is similar to the induction assembly 423 shown in FIG. 8 and comprises the flat spiral inductor coil 26 and a susceptor element 724 comprising only a planar portion 727. The planar portion 727 comprises a central hub 737 and a plurality of fins 739 extending radially outward from the central hub 737. The spaces between adjacent fins 739 form a plurality of airflow apertures 735 extending through the planar portion 727. During use, airflow from the air inlet 44 flows through the plurality of airflow apertures 735 to preheat the airflow before it enters the aerosol-forming substrate 34 of the aerosol-generating article 14.

Figure 12:
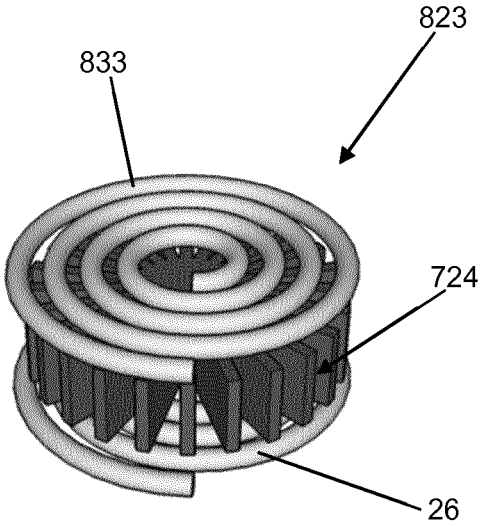
FIG. 12 shows a perspective view of a still further alternative induction assembly for the aerosol-generating device of FIG. 2A.

FIG. 12 shows an induction assembly 823 that is substantially the same as the induction assembly 723 shown in FIG. 11 and comprises the same susceptor element 724 and flat spiral inductor coil 26. The flat spiral inductor coil 26 is a first flat spiral inductor coil 26 and the induction assembly 823 additionally comprises a second flat spiral inductor coil 833. The first and second flat spiral inductor coils 26, 833 are arranged so that the planar portion 727 of the susceptor element 724 is positioned between the first and second flat spiral inductor coils 26, 833. As described with reference to FIG. 6, providing two flat spiral inductor coils increases the inductive heating of the planar portion 727 of the susceptor element 724.

Figure 13:
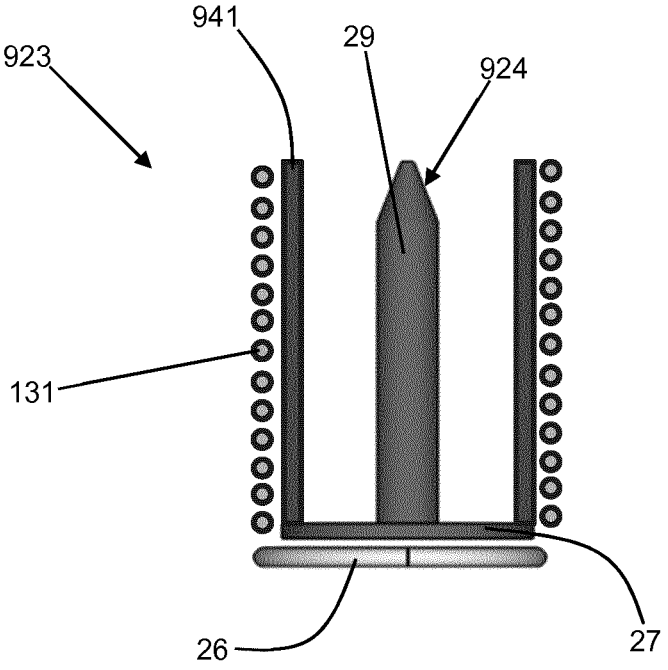
FIG. 13 shows a cross-sectional view of a still further alternative induction assembly for the aerosol-generating device of FIG. 2A.

FIG. 13 shows an induction assembly 923 that is substantially the same as the induction assembly 123 shown in FIG. 5. The susceptor element 924 of the induction assembly 923 additionally comprises sleeve portion 941 extending from the planar portion 27 and disposed within the helical inductor coil 131. During use, the controller 30 provides an alternating electric current to the flat spiral inductor coil 26 to inductively heat the planar portion 27 and provides an alternating electric current to the helical inductor coil 131 to inductively heat the elongate portion 29 and the sleeve portion 941.

The invention claimed is:

1. An aerosol-generating device, comprising:

a housing defining a chamber having an open end configured for insertion of an aerosol-generating article into the chamber and a closed end disposed opposite the open end;

a flat spiral inductor coil disposed at the closed end of the chamber;

a susceptor element disposed within the chamber at the closed end; and a power supply and a controller connected to the flat spiral inductor coil and configured to provide an alternating electric current to the flat spiral inductor coil such that the flat spiral inductor coil is configured to generate an alternating magnetic field to inductively heat the susceptor element and thereby to heat at least a portion of an aerosol-generating article received within the chamber.

2. The aerosol-generating device according to claim 1, wherein the housing defines a longitudinal axis extending between the closed end and the open end of the chamber, and wherein the flat spiral inductor coil lies within a plane that is orthogonal to the longitudinal axis.

3. The aerosol-generating device according to claim 1, wherein the housing defines a chamber end wall forming the closed end of the chamber, and wherein the flat spiral inductor coil is disposed on the chamber end wall.

4. The aerosol-generating device according to claim 3, wherein the chamber end wall comprises a first surface defining the closed end of the chamber and an opposed second surface, and wherein the flat spiral inductor coil is disposed on the first surface of the end wall within the chamber.

5. The aerosol-generating device according to claim 3, wherein the chamber end wall comprises a first surface defining the closed end of the chamber and an opposed second surface, and wherein the flat spiral inductor coil is disposed on the opposed second surface of the end wall.

6. The aerosol-generating device according to claim 5, wherein the housing defines a cavity in which the power supply, the controller, and the flat spiral inductor coil are disposed, and wherein the opposed second surface of the end wall defines a first end of the cavity.

7. The aerosol-generating device according to claim 1, wherein the susceptor element comprises a planar portion disposed within the chamber at the closed end, and wherein the planar portion extends within a plane parallel with the flat spiral inductor coil.

8. The aerosol-generating device according to claim 7, wherein the susceptor element further comprises at least one airflow aperture extending through the planar portion between a first side of the planar portion and a second side of the planar portion.

9. The aerosol-generating device according to claim 7, wherein the planar portion comprises a central hub and a plurality of fins extending radially outward from the central hub.

10. The aerosol-generating device according to claim 7, wherein the susceptor element further comprises at least one elongate portion extending from the planar portion and into the chamber.

11. The aerosol-generating device according to claim 7, wherein the susceptor element further comprises a sleeve portion extending from a periphery of the planar portion, and wherein the sleeve portion is disposed around at least a portion of the chamber and is configured to receive at least a portion of the aerosol-generating article within the sleeve portion.

12. The aerosol-generating device according to claim 7, wherein the flat spiral inductor coil is a first flat spiral inductor coil and the aerosol-generating device further comprises a second flat spiral inductor coil, wherein the first flat spiral inductor coil, the second flat spiral inductor coil, and the planar portion of the susceptor element are parallel with each other, and wherein the planar portion is disposed between the first flat spiral inductor coil and the second flat spiral inductor coil.

13. The aerosol-generating device according to claim 12, wherein the planar portion is a first planar portion and the susceptor element further comprises a second planar portion separate from the first planar portion, wherein the second planar portion extends within a plane parallel with the second flat spiral inductor coil, and wherein the second flat spiral inductor coil is disposed between the first planar portion and the second planar portion.

14. The aerosol-generating device according to claim 1, further comprising an additional inductor coil disposed around at least a portion of the chamber, wherein the power supply and the controller are connected to the additional inductor coil and are configured to provide an alternating electric current to the additional inductor coil.

15. An aerosol-generating system, comprising:

an aerosol-generating device according to claim 1; and an aerosol-generating article having an aerosol-forming substrate and being configured for use with the aerosol-generating device.

* * * * *